United States Patent [19]

Elter

[11] 3,953,709

[45] Apr. 27, 1976

[54] TWO SOURCE RADIANT FUSER FOR XEROGRAPHIC REPRODUCING APPARATUS

[75] Inventor: John F. Elter, Rochester, N.Y.

[73] Assignee: Xerox Corporation, Stamford, Conn.

[22] Filed: Feb. 25, 1974

[21] Appl. No.: 446,039

[52] U.S. Cl. ..... 219/216; 219/388; 250/317

[51] Int. Cl.[2] ..... H05B 1/00

[58] Field of Search ..... 219/216, 388; 355/9; 250/317–319; 118/637; 432/59–60, 227–228

[56] References Cited

UNITED STATES PATENTS

| | | | |
|---|---|---|---|
| 3,449,546 | 6/1969 | Dhoble | 219/216 |
| 3,452,181 | 6/1969 | Stryjewski | 219/216 |
| 3,475,589 | 10/1969 | Bartusek et al. | 219/216 |
| 3,498,592 | 3/1970 | Moser et al. | 219/388 X |
| 3,622,745 | 11/1971 | Shepard | 219/388 X |
| 3,642,365 | 2/1972 | Egnaczak et al. | 355/8 |
| 3,781,516 | 12/1973 | Tsilibos et al. | 219/388 X |
| 3,811,828 | 5/1974 | Ohta | 432/227 |
| 3,836,322 | 9/1974 | Harwig | 219/388 X |

*Primary Examiner*—C. L. Albritton

[57] ABSTRACT

Apparatus for heat fixing toner images electrostatically adhered to copy paper. The apparatus is characterized by the provision of plural radiant energy sources capable of fusing high density images without scorching light weight paper and fusing low density images without fusing background toner particles. The energy source for fusing low density images comprises a low mass resistance heating element which radiates energy at wavelengths suitable for absorption by the paper in order to fuse low density toner images.

6 Claims, 5 Drawing Figures

TWO SOURCE RADIANT FUSER FOR XEROGRAPHIC REPRODUCING APPARATUS

BACKGROUND OF THE INVENTION

This invention relates generally to electrostatographic apparatus and, more particularly, to radiant energy apparatus for fixing toner images to a support member.

In the process of electrostatography, latent electrostatic images are formed on a support member, for example, plain paper with the subsequent rendering of the latent images visible by the application of electroscopic marking particles, commonly referred to as toner. The toner or powder images so formed vary in density in accordance with the magnitude of electrostatic charges forming the individual images.

The toner images can be fixed directly upon the support member on which they are formed or they may be transferred to another support member with subsequent fixing of the images thereto.

Fixing of toner images can be accomplished by various methods one of which is by the employment of thermal energy. In order to permanently fix or fuse toner images onto a support member by means of thermal energy it is necessary to elevate the temperature of the toner material to a point at which the constituents of the toner coalesce and become tacky or melt. This action causes the toner to be absorbed to some extent into the fibers of the paper. Thereafter as the toner cools, solidification of the toner material occurs causing it to be firmly bonded to the support member. In the process of electrostatography, the use of thermal energy for fixing toner images is old and well known.

One approach to thermal fusing of toner images onto a support member is to pass the support with the toner images thereon past a source of radiant energy such that the image bearing side of the support is opposite the source of radiation while the reverse side thereof is moved in contact with a support platen.

In order to be totally acceptable, a radiant fuser, for use in the type of apparatus contemplated, requires a wide fuse-scorch latitude. In other words, it should be capable of fusing high density images without scorching light weight (i.e. less than 20lbs. - basis weight 2000 sheets) copy paper and it should be capable of fusing low density images without fusing background toner particles. It should also be capable of rapid warm-up.

Prior attempts at meeting all the foregoing requirements in a single radiant fuser have been unsuccessful.

Accordingly, it is the primary object of this invention to provide a new and improved radiant fuser for use in an electrostatographic apparatus.

It is a more particular object of this invention to provide, in a xerographic reproducing apparatus, a radiant fuser having a wide fuse-scorch latitude which also has a short warm-up time.

Another object of this invention is to provide a new and improved radiant fuser having plural energy sources one of which comprises a quartz lamp radiating short wavelength energy readily absorbed by toner and the other of which comprises a low mass element capable of radiating long wavelength energy which is readily absorbed by the copy paper.

BRIEF SUMMARY OF THE INVENTION

Briefly, the above-cited objects are accomplished by the provision of a low mass energy source which radiates long wavelength energy for effecting fusing of low density images without fusing background toner particles and a quartz lamp which radiates short wavelength energy for effecting fusing of high density images.

In one embodiment of the invention a voltage is applied to the low mass energy source to provide the power required for it to radiate the long wavelength energy.

In another embodiment of the invention, the low mass energy source receives its energy from the quartz lamp.

Further objects and advantages of the present invention will become apparent in view of the detailed description to follow when read in conjunction with the accompanying drawings wherein.

DETAILED DESCRIPTION OF THE PREFERRED EMBODIMENTS

Figure 1:
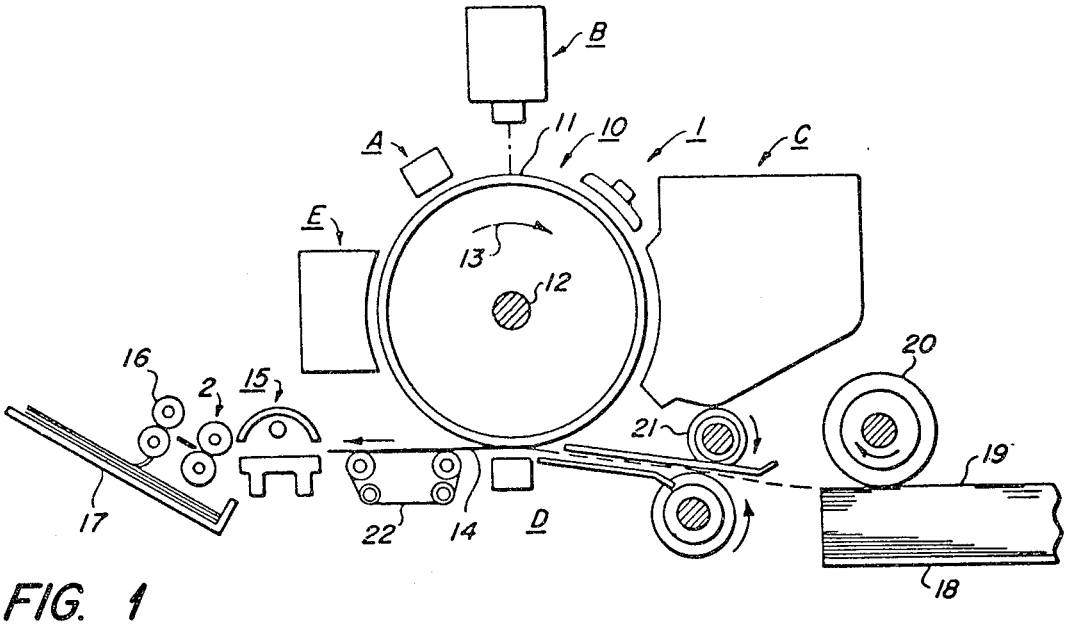
FIG. 1 is a schematic representation of a reproducing apparatus incorporating the invention.

Referring now to FIG. 1, there is shown by way of example an automatic xerographic reproducing machine 1 which incorporates the improved fusing apparatus 15 of the present invention. The reproducing machine 1 depicted in FIG. 1 illustrates the various components utilized therein for producing copies from an original. Although the fusing apparatus 15 of the present invention is particularly well adapted for use in an automatic xerographic reproducing machine 1, it should become evident from the following description that it is equally well suited for use in a wide variety of machines where an image is fused to a sheet of final support material and it is not necessarily limited in its application to the particular embodiment shown herein.

The reproducing machine 1 illustrated in FIG. 1 employs an image recording drum-like member 10 the outer periphery of which is coated with a suitable photoconductive material 11. One type of suitable photoconductive material is disclosed in U.S. Pat. No. 2,970,906 issued to Bixby in 1961. The drum 10 is suitably journaled for rotation within a machine frame (not shown) by means of a shaft 12 and rotates in the direction indicated by arrow 13, to bring the image retaining surface thereon past a plurality of xerographic processing stations. Suitable drive means (not shown) are provided to power and coordinate the motion of the various cooperating machine components whereby a faithful reproduction of the original input scene information is recorded upon a sheet 14 of final support material such as paper or the like.

Since the practice of xerography is well-known in the art, the various processing stations for producing a copy of an original are herein represented in FIG. 1 as blocks A to E. Initially, the drum 10 moves photoconductive surface 11 through charging station A. At charging station A an electrostatic charge is placed uniformly over the photoconductive surface 11 of the drum 10 preparatory to imaging. The charging may be provided by a corona generating device of a type described in U.S. Pat. No. 2,836,725 issued to Vyverberg in 1958.

Thereafter, the drum 10 is rotated to exposure station B where the charged photoconductive surface 11 is exposed to a light image of the original input scene information, whereby the charge is selectively dissipated in the light exposed regions to record the original input scene in the form of a latent electrostatic image. A suitable exposure system may be of the type described in U.S. Pat. application, Ser. No. 259,181 filed June 2, 1972.

After exposure, drum 10 rotates the electrostatic latent image recorded on the photoconductive surface 11 to development station C wherein a conventional developer mix is applied to the photoconductive surface 11 of the drum 10 rendering the latent image visible. A suitable development station is disclosed in U.S. Pat. application, Ser. No. 199,481 filed Nov. 17, 1971. The application describes a magnetic brush development system utilizing magnetizable developer mix having carrier granules and toner colorant. The developer mix is continuously brought through a directional flux field to form a brush thereof. The electrostatic latent image recorded on photoconductive surface 11 is developed by bringing the brush of developer mix into contact therewith.

The developed image on the photoconductive surface 11 is then brought into contact with a sheet 14 of final support material within a transfer station D and the toner image is transferred from the photoconductive surface 11 to the contacting side of the final support sheet 14. The final support material may be paper, plastic, etc. as desired. After the toner image has been transferred to the sheet of final support material 14, the sheet with the image thereon is advanced to a fuser assembly 15, which fixes the transferred powdered image thereto. After the fusing process, the sheet 14 is advanced through a snuffing apparatus 2 then by rolls 16 to a catch tray 17 for subsequent removal therefrom by the machine operator.

Although a preponderance of the toner powder is transferred to the final support material 14, invariably some residual toner remains on the photoconductive surface 11 after the transfer of the toner powder image to the final support material 14. The residual toner particles remaining on the photoconductive surface 11 after the transfer operation are removed from the drum 10 as it moves through cleaning station E. Here the residual toner particles are first brought under the influence of a cleaning corona generating device (not shown) adapted to neutralize the electrostatic charge remaining on the toner particles. The neutralized toner particles are then mechanically cleaned from the photoconductive surface 11 by conventional means as for example the use of a resiliently biased knife blade as set forth in U.S. Pat. No. 3,660,863 issued to Gerbasi in 1972.

If desired, in accordance with the invention, the sheets 14 of final support material processed in the automatic xerographic reproducing device can be stored in the machine within a removable paper cassette 18. A suitable paper cassette is set forth in U.S. Pat. application, Ser. No. 208,138 filed Dec. 15, 1971.

The reproducing apparatus in accordance with this invention can also have the capability of accepting and processing copy sheets 14 of varying lengths. The length of the copy sheet 14, of course, being dictated by the size of the original input scene or information recorded on the photoconductive surface 11. To this end the paper cassette 18 is preferably provided with an adjustable feature whereby sheets of varying length and width can be conveniently accommodated. In operation the cassette 18 is filled with a stack of final support material 19 of pre-selected size and the cassette 18 is inserted into the machine by sliding along a base plate (not shown) which guides the cassette into operable relationship with a pair of feed rollers 20. When properly positioned in communication with the feed rollers 20, the top sheet of the stack 19 is separated and forwarded from the stack 19 into the transfer station D by means of registration rolls 21.

It is believed that the foregoing description is sufficient for purposes of the present application to illustrate the general operation of the automatic xerographic reproducing machine 1 which can embody the teachings of the present invention.

Figure 2:
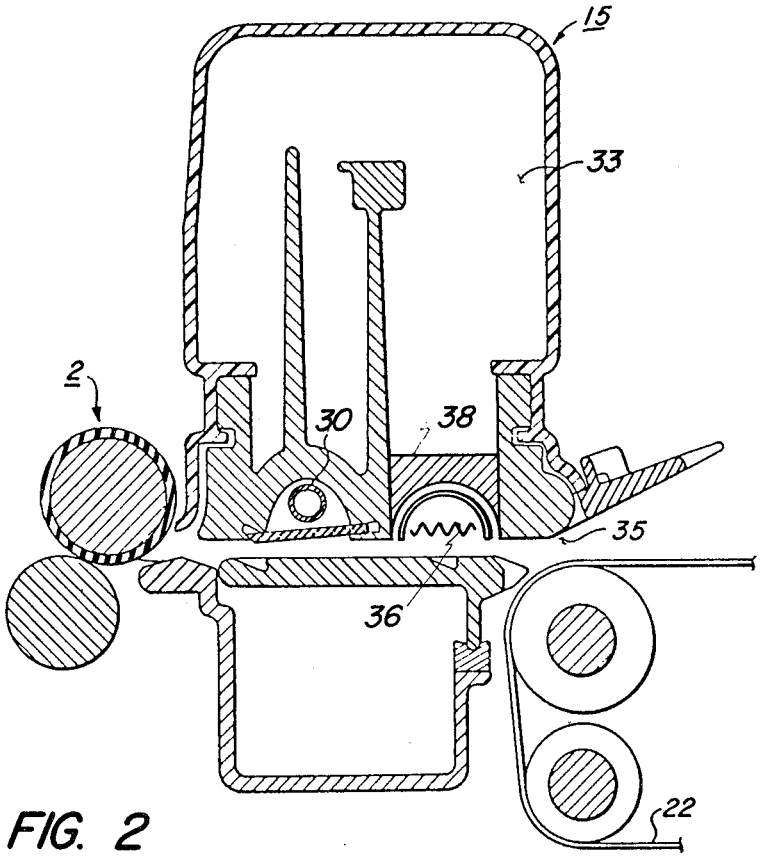
FIG. 2 illustrates schematically a sectional view, in elevation, of a radiant fuser incorporated in the apparatus of FIG. 1.

Referring now to FIG. 2, that portion of the reproducing machine 1 of FIG. 1 embodying the fusing apparatus 15 of this invention is shown in greater detail. The image bearing sheet 14 after passing through the transfer station D of FIG. 1 upon separation from the photoconductive surface 11 is allowed to fall into contact with a vacuum belt transport system 22 which conveys the sheet directly to the fusing station 15.

The density of the toner images on the sheet 14 vary in accordance with the density of the electrostatic images formed thereon and therefore usually comprise high and low density images as well as background toner particles. Image density may be defined by the equation:

$$D = \log_{10} L_i/L_r$$

where $L_i$ = incident light on image and $L_r$ = reflected light by image.

From the foregoing it can be seen that when the reflected light is equal to the incident light the image density is equal to zero. Contrariwise, if none of the incident light is reflected by the image then the image density is equal to 1. In accordance with the foregoing, images whose density is equal to 1 are considered the highest density images and those whose densities are equal to 0.2 or less are considered low density images. Background toner particles, therefore, those toner particles which are on the copy paper but do not form a part of the images, have densities on the order of 0.05.

When the images have high densities (i.e. above 0.2) they act more like true black bodies with respect to radiant heat energy incident thereon, in that, they absorb a large percentage of that energy. A good source of radiant energy, that is one which converts a higher percentage of the available energy to radiant heat energy, will produce high intensity radiation concentrated about a wavelength at which peak power occurs. The higher the temperature of the source, the more concentrated will be the energy within a narrow band of wavelengths and the higher will be the intensity of the energy. A relationship also exists between the peak power wavelength and the source temperature. The higher the source temperature the closer the peak power wavelength is toward the shorter wavelength end of the spectrum useful for heating materials such as toner.

In accordance with the foregoing, a radiant energy source, for example, a quartz lamp 30 is provided which is designed to operate at a temperature of 2400°K at a power level of 850 watts. Quartz lamps for the purpose intended herein are well known, consequently, no further discussion thereof will be presented. Under these operating conditions, the quartz lamp will effectively fuse the high density images on a standard xerographic copy sheet 14. This has been found to be the case with papers on the order of 20 lbs. or less (basis weight 2000 sheets). The quartz lamp is mounted in a reflector assembly 32 in opposing relationship to a support platen 34 and in a position to thermally communicate with the toner images on the copy sheet 14.

By applying an additional amount of power to the lamp 30, fusing of low density images could be accomplished, however, papers lighter than 20 lb. would experience scorching. Under certain conditions even the 20 lb. paper can experience scorching at the elevated power level.

Accordingly, a second source of radiant energy is provided in the form of a resistance heater structure 36 which is designed to operate at 800°C at 300 watts of power. The heater structure 36 is fabricated from a material which has a thickness on the order of 1 mil and extends for a distance of approximately 1-½ inches in the direction of travel of the copy sheet 14. The heater structure 36 constitutes a low mass source of radiant energy which has a very short warm-up period (on the order of 3 seconds). The structure 36 is fabricated from a stainless steel material wherein at least some of the chromium is replaced by cobalt. Such a material is available under the trade name Waspalloy, from Hamilton Metals Corp., a division of Hamilton Watch. Thermal insulation 38 is provided in order to retard energy losses from the heater structure 36. By provision of the heater structure 36, means for elevating the temperature of the paper in order to fuse low density images without fusing the background particles is available. It will be appreciated that the energy absorptance of the toner remains roughly the same for the different wavelengths, however, the paper absorptance increases to thereby adequately heat the paper and fuse low density images.

Figure 3:
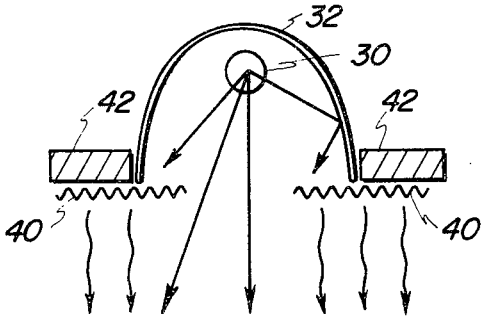
FIG. 3 is a modified form of the fuser illustrated in FIG. 2.

In a modified form of the invention, as illustrated in FIG. 3, the heater structure 36 is replaced by a pair of low mass ribbons 40 which are heated by some of the energy emitted from the quartz heater 30. In this embodiment, the opening provided between the low mass ribbons may be chosen so that about 70% of the energy from the lamp 30 passes therethrough. The ribbons reradiate the energy absorbed thereby which energy, because its peak power is concentrated about higher wavelengths, will be readily absorbed by the paper.

Figure 4:
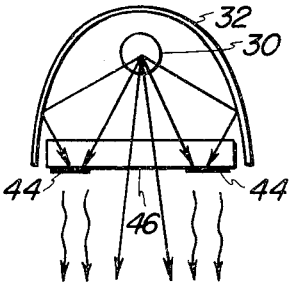
FIG. 4 is another modified form of the fuser illustrated in FIG. 2.

As shown in FIG. 4, the ribbons 40 which are supported by insulating material 42 (in any conventional manner) are replaced by metallic layers 44 which may be vapor deposited on a quartz window 46. The quartz window is transparent to the radiation emanating from the quartz lamp, but the metallic layers absorb a portion of this energy with reradiation thereby at longer wavelengths.

Figure 5:
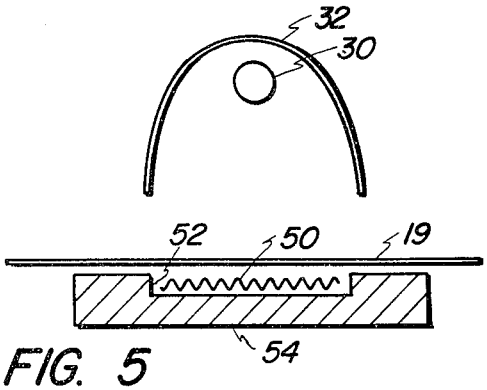
FIG. 5 is a further modified form of the fuser illustrated in FIG. 2.

As illustrated in FIG. 5, the ribbon 50 is disposed in a recess 52 in a platen 54. In this embodiment, the ribbon in heated by the quartz lamp when there is no paper in the fuser. When paper is in the fuser a source of power (not shown) is applied to the ribbon.

While the invention has been described with respect to specific embodiments it is not intended that the claims should be limited thereby.

What is claimed is:

1. Radiant fuser for fixing toner images to copy substrates, said fuser comprising:

a first radiant source of energy for fushing high density images without scorching said copy substrates; and a second source of radiant energy for fusing low density images without fusing background toner particles, said second source of radiant energy comprising a low mass member capable of rapid temperature increases and operating at a temperature of about 800°C.

2. Apparatus according to claim 1, wherein said first source of radiant energy comprises a quartz lamp operating at a temperature of approximately 2400°K.

3. Apparatus according to claim 1, wherein said second source of energy comprises means for absorbing energy from said first source of energy and reradiating said energy.

4. Apparatus according to claim 3, wherein said second source of energy is secured to a quartz window disposed intermediate said first and second radiant sources.

5. Apparatus according to claim 1, wherein both of said energy sources are disposed on the same side of said copy substrate.

6. Apparatus according to claim 1, wherein said energy sources are disposed on opposite sides of said copy substrate.

* * * * *